United States Patent [19]

Pragt

[11] Patent Number: 5,008,592

[45] Date of Patent: Apr. 16, 1991

[54] HALOGEN INCANDESCENT LAMP AND METHOD OF MANUFACTURING A HALOGEN INCANDESCENT LAMP

[75] Inventor: Henrikus J. H. Pragt, Eindhoven, Netherlands

[73] Assignee: U.S. Philips Corporation, New York, N.Y.

[21] Appl. No.: 425,894

[22] Filed: Oct. 23, 1989

[30] Foreign Application Priority Data

Nov. 15, 1988 [NL] Netherlands ..... 8802803

[51] Int. Cl.[5] ..... H01J 9/26; H01K 3/20; H01K 1/38

[52] U.S. Cl. ..... 313/623; 313/579; 313/271; 313/332; 445/27; 445/32

[58] Field of Search ..... 313/623, 579, 332, 271, 313/274, 276; 445/27, 32, 43

[56] References Cited

U.S. PATENT DOCUMENTS 2,664,517 12/1953 Wiener ..... 313/332 X
4,535,268 8/1985 Morris et al. ..... 313/579 X
4,623,817 11/1986 Morris et al. ..... 313/271 X

*Primary Examiner*—Sandra L. O'Shea
*Attorney, Agent, or Firm*—Robert J. Kraus

[57] ABSTRACT

The halogen incandescent lamp has a tipless lamp vessel (1) having a first seal (3), in which a current supply conductor (7) with a foil-shaped part (9) of small width ($w_1$) is accommodated, and a second seal (4), in which a current supply conductor (8) with a foil-shaped part (10) of larger width ($w_2$) is accommodated. This construction permits a simple method of manufacturing the lamp, in which the tube from which the lamp vessel (1) is formed has a constriction which allows the first current supply conductor (7) and the filament (5) to pass, but stops the foil-shaped part (10) of the second current supply conductor (8) and holds the filament positioned in axial direction in the tube.

5 Claims, 1 Drawing Sheet

HALOGEN INCANDESCENT LAMP AND METHOD OF MANUFACTURING A HALOGEN INCANDESCENT LAMP

BACKGROUND OF THE INVENTION

The invention relates to a halogen incandescent lamp comprising a tubular tipless glass lamp vessel sealed in a vacuum-tight manner and having an axis, this lamp vessel having at each end a first and a second seal, respectively, through which one respective current supply conductor is passed;

a filament having an axis axially arranged in the lamp vessel;

first and second current supply conductors, which are connected to the filament and have a first and a second foil-shaped part, respectively, which is accommodated in a respective seal, and an external part which is connected thereto and projects outwards from the lamp vessel;

a halogen-containing gas in the lamp vessel, the foil-shaped parts each having a width dimension transverse to the axis of the lamp vessel.

The invention further relates to a method of manufacturing such a lamp, in which a filament is axially arranged in a glass tube having an axis through an open first end thereof, means being provided for holding the filament positioned in the axial direction of the tube;

the glass tube is heated at the area of the first foil-shaped part and a first seal is formed in the tube, in which seal the first foil-shaped part is accommodated;

the tube is filled with a halogen-containing gas, the tube is sealed in a vacuum-tight manner by heating the tube at the area of the second foil-shaped part and forming a second seal in the tube axially spaced apart from the first seal, the second foil-shaped part being accommodated in said second seal.

Such a lamp and a method of manufacturing such a lamp are known from U.S. Pat. No. 3,759,601.

In the manufacture of the known lamp, the second current supply conductor has at its external part a transverse beam having a length greater than the inner diameter and smaller than the outer diameter at the open first end of the tube. The transverse beam must abut against the open first end of the tube when the filament has been entirely introduced into said tube in order to hold the filament positioned in the axial direction in the tube during the manufacture of the lamp. Since in general the tube has a fairly thin wall of about 1 mm thickness, the length of the beam must lie within very narrow limits. However, when the filament is introduced into the tube, the beam can readily occupy an oblique position with respect to the axis of the tube or can be not entirely centered with respect to the tube, as a result of which the beam slides into the tube. In order to center the beam, the external part of the second current supply conductor is in the form of a helically wound wire, onto which a wire is wound, which spirals out to the wall of the tube.

A disadvantage of the known lamp is that its manufacture requires a complicated auxiliary construction. It is also a disadvantage that the external part of the second current supply conductor must be thin in order that it can be wound helically, just like the filament. The part projecting from the lamp vessel in the finished lamp must therefore be shielded from the air in order to prevent it from being burned.

U.S. Pat. No. 4,623,817 discloses a halogen incandescent lamp, which also has a tubular lamp vessel provided with a seal at both ends. To the filament which is axially arranged therein, current is supplied through only one of the seals, however. The lamp is consequently suitable for use in a copying apparatus, in which the other seal is not readily accessible for connection to an electric supply source. Through the relevant seal, two current supply conductors are passed into the lamp vessel, these conductors each having in this seal a foil-shaped part. One of the current supply conductors is connected to the adjacent end of the filament, while the second current supply conductor extends, whilst being surrounded by an insulator, to the other seal. This other seal accommodates a comparatively wide metal foil, which is connected through a conductor to the adjacent end of the filament for mechanically fixing the same. Said conductor is also connected directly or through the metal foil to the second current supply conductor to constitute a current path through the lamp.

SUMMARY OF THE INVENTION

The invention has for its object to provide a halogen incandescent lamp of the kind described in the opening paragraph, which has a simple construction permitting a simple method of manufacturing.

According to the invention, this object is achieved in that the width dimension of the second foil-shaped part is larger than the width dimension of the first foil-shaped part.

During the manufacture of the lamp, the wide second foil-shaped part cooperates with a constriction in the tube, from which the lamp vessel is formed. This constriction allows upon introduction of the filament into said tube, the first current supply conductor and the filament to pass, but stops the comparatively wide second foil-shaped part.

It is favourable when the width dimension of the second foil-shaped part is at least about 1.5 times the width dimension of the first foil-shaped part.

The constriction in the tube may be an indentation in the tube, for example a continuous rib. However, the constriction may be obtained by fusing a comparatively narrow tube portion in a butt weld with a wider tube portion. Alternatively, a comparatively wide tube may be given a tube portion of smaller width by upsetting it.

In case the constriction in the tube is due to a difference in wall thickness, this can be observed in the finished lamp in that the second seal has a smaller cross-section at the area of the foil-shaped part and the external part of the current supply conductor than elsewhere.

The seals may be pinched seals, the tube softened by heating being pinched by pinching blocks, or the seals may be fused, the tube softened by heating being constricted due to a higher pressure outside the tube than in the tube when forming the relevant seal. The first seal may be such a fused seal when a tube is used which has a closed end opposite to the open first end.

BRIEF DESCRIPTION OF THE DRAWING

Embodiments of the halogen incandescent lamp and the method according to the invention are shown in the drawings. In the drawings.

DESCRIPTION OF THE PREFERRED EMBODIMENTS

Figure 1:
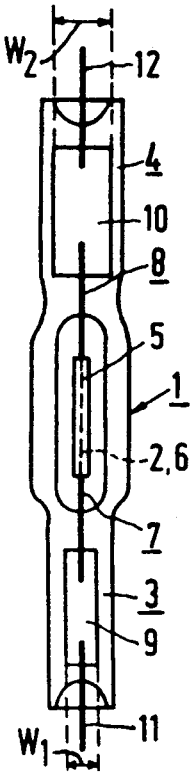
FIG. 1 is a side elevation of a halogen incandescent lamp.

In FIG. 1, the halogen incandescent lamp has a tipless tubular lamp vessel which is sealed in a vacuum-tight manner and consists of glass, for example glass having an $SiO_2$ content of at least 95% by weight, such as quartz glass. The lamp vessel 1 has an axis 2 and at each end a first seal 3 and a second seal 4, respectively, through which one respective current supply conductor is passed. A tungsten filament 5 having an axis 6 is arranged axially, in the drawing coaxially, in the lamp vessel 1. A first current supply conductor 7 and a second current supply conductor 8 are connected to the filament 5 and these conductors have a first foil-shaped part 9 and a second foil-shaped part 10 accommodated in respective seals 3 and 4. An external part 11 and 12, respectively, connected thereto projects outwards from the lamp vessel 1. The foil-shaped parts 9, 10 each have a width dimension $W_1$ and $W_2$, respectively, transverse to the axis 2 of the lamp vessel 1. The lamp vessel 1 comprises a halogen-containing gas, for example xenon, containing 0.1% by volume of $CH_2Br_2$.

The width dimension $W_2$ of the second foil-shaped part 10 is larger than the width dimension $W_1$ of the first foil-shaped part 9, in the drawing about two times larger.

Figure 2:
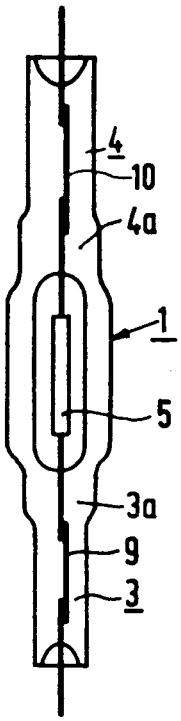
FIG. 2 shows the lamp of FIG. 1 rotated through 90°.

In FIG. 2, the part 4*a* of the second seal 4 has, just like the part 3*a* of the first seal 3, a larger transverse dimension that the remaining part of said seal due to the fact that the tube from which the lamp vessel 1 has been formed had a larger wall thickness at that area (compare FIGS. 4–7).

In FIGS. 3–7, parts corresponding to parts in FIGS. 1–2 have a reference numeral which is 20 higher.

Figure 3:
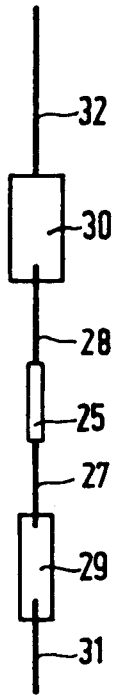
FIGS. 3 to 7 show intermediate products in the manufacture of a halogen incandescent lamp.

FIG. 3 shows the assembly of a filament 25 and the current supply conductors 27, 28 connected thereto.

Figure 4:
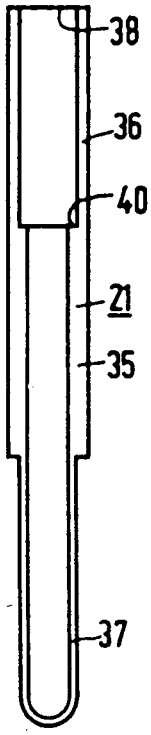

From the glass tube 21 of FIG. 4 a lamp vessel is formed. The tube has a central part 35, with which an end portion 36 of larger inner diameter is fused in a butt joint. An end portion 37 is also fused with the central part 35 in a butt joint.

Due to the difference in inner diameters, the tube 21 has a constriction 40. The tube 21 has an open first end 38 and a second end 39, which is closed.

Figure 5:
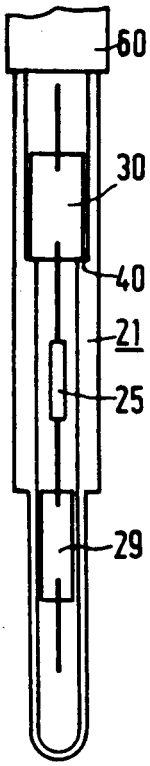

In FIG. 5, the filament 25 is introduced into the tube 21 through the open first end 38. The constriction 40 has allowed the filament 25 and the first current supply conductor 27 to pass and stops the second foil-shaped part 30. The tube 21 is accommodated at its first end 38 in a product holder 60.

Figure 6:
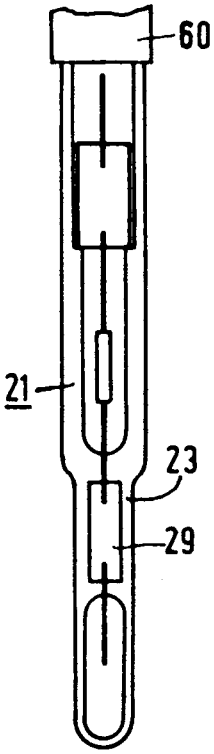

Through the first open end 38, a subatmospheric pressure is produced in the tube; the tube 21 is locally heated and the first seal 23 is formed, into which the foil-shaped part 29 is sealed (FIG. 6). In another embodiment of the method, a tube (21) with an open second end (39) may be used. With a flow of inert gas, which enters at the first end (38), a pinched seal can then be formed after local heating as a first seal (23).

Figure 7:
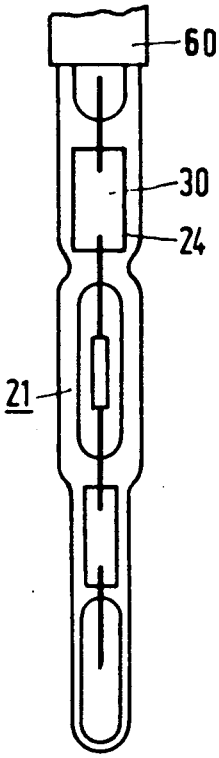

In FIG. 7, the tube 21 is locally heated and, the tube being for the major part immersed in a cold medium, for example liquid nitrogen, in order to obtain in the tube a gas filling of low pressure, it is fused to form the second seal 24. The product holder 60 during said last step is in open connection with a gas container having a chosen volume, in which under chosen conditions of temperature and pressure a filling gas is present. Under the influence of the low temperature the tube has assumed due to the cold medium, the filling gas has flown into the tube before the second seal is formed.

Another possibilitity is that the assembly of FIG. 5 is fused at the first end 38 of the tube 21 (FIG. 4) with a glass vessel of chosen volume, into which after evacuation of said vessel and of the tube 21 a filling gas is introduced under chosen conditions of temperature and pressure. This glass vessel then replaces the gas container of the product holder 60.

Figure 8:
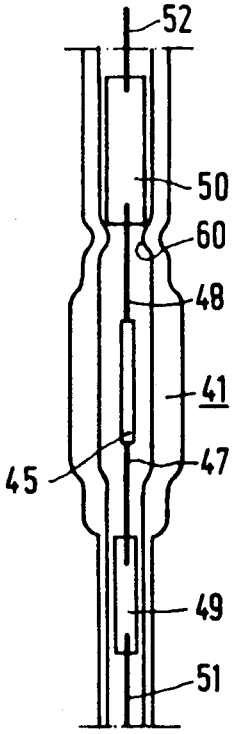
FIG. 8 shows a variation of FIG. 5.

In FIG. 8, parts corresponding to parts in FIGS. 3 and 4 have a reference numeral which is 20 higher. The constriction 60 in the tube 41 in this figure is an indentation.

I claim:

1. An incandescent lamp comprising a sealed, tubular, tiples envelope containing a halogen containing gas and having a central longitudinal axis along which is disposed a filament and first and second current supply conductors connected to respective first and second ends of the filament, characterized in that:

a. the first current supply conductor includes an intermediate widened portion having a width which is smaller than a first internal diameter of an adjacent first portion of the envelope which exists before sealing of the envelope, but is larger than a second internal diameter of the envelope for stopping entry of the widened portion into the envelope and facilitating axial positioning of the filament before sealing of the envelope, and having a thickness which is substantially smaller than said second internal diameter;

b. the second current supply conductor includes an intermediate widened portion having a width which is smaller than both the second internal diameter and the internal diameter of an adjacent second portion of the envelope which exists before sealing of the envelope; and c. the envelope is sealed around the widened portions of the first and second current supply conductors, with distal ends of said conductors projecting from respective ends of said envelope.

2. An incandescent lamp as in claim 1 where the width of the intermediate widened portion of the first current supply conductor is at least 1.5 times the width of the intermediate widened portion of the second current supply conductor.

3. A method of manufacturing a halogen incandescent lamp comprising a tipless glass lamp vessel sealed in a vacuum-tight manner and having an axis, this lamp vessel having on each side a first and a second seal, respectively, in which a filament having an axis is connected to a first and a second current supply conductor having a first and a second foil-shaped part, respectively, and an external part connected thereto, which foil-shaped parts each have a width dimension transverse to the axis of the filament, the filament is axially introduced into a glass tube having an axis through an open first end thereof, means being provided for holding the filament positioned in the axial direction of the tube, the glass tube is heated at the area of the first foil-shaped part and a first seal is formed in the tube, in which the first foil-shaped part is accommodated;

the tube is filled with a halogen-containing gas, the tube is sealed in a vacuum-tight manner by heating the tube at the area of the second foil-shaped part and forming a second seal in the tube in the axial direction at a certain distance from the seal, the second foil-shaped part being accommodated in this second seal, characterized in that the width dimension of the second foil-shaped part is larger than the width dimension of the first foil-shaped part and the glass tube has a constriction which allows the first current supply conductor and the filament to pass and stops the second foil-shaped part.

4. A method as claimed in claim 3, characterized in that a glass tube is used, in which the constriction is an indentation in the tube.

5. A method as claimed in claim 3, characterized in that a glass tube is used, in which the constriction is formed by a first at least locally internally narrow tube part, which is fused in a butt weld with a second internally wider tube part.

* * * * *